US006675997B1

(12) United States Patent
Gouldson et al.

(10) Patent No.: US 6,675,997 B1
(45) Date of Patent: Jan. 13, 2004

(54) GARMENT HANGER

(75) Inventors: Stanley F. Gouldson, Northport, NY (US); Olaf Olk, Hauppauge, NY (US)

(73) Assignee: Spotless Plastics Pty. Ltd., Moorabbin (AU)

( * ) Notice: Subject to any disclaimer, the term of this patent is extended or adjusted under 35 U.S.C. 154(b) by 0 days.

(21) Appl. No.: 10/216,029

(22) Filed: Aug. 9, 2002

(51) Int. Cl.[7] ..... A41D 27/22
(52) U.S. Cl. ..... 223/89; 223/94
(58) Field of Search ..... 223/89, 94, 85, 223/87, 86; 206/213, 787.1, 292, 293, 278

(56) References Cited

U.S. PATENT DOCUMENTS

| | | | | | |
|---|---|---|---|---|---|
| 952,202 | A | * | 3/1910 | Klingenfeld | 223/89 |
| 4,300,688 | A | * | 11/1981 | London et al. | 206/286 |
| 4,669,642 | A | * | 6/1987 | Nicholas | 223/94 |
| 6,026,998 | A | * | 2/2000 | Brooks | 223/94 |

* cited by examiner

*Primary Examiner*—John J. Calvert
*Assistant Examiner*—James G Smith

(74) *Attorney, Agent, or Firm*—Scully, Scott, Murphy & Presser

(57) ABSTRACT

A garment hanger which is suitable for packaging and merchandising intimate apparel such as ladies panties. The garment hanger is formed as one integrally molded plastic piece which includes a main body about which the apparel is folded by a pair of foldable arms which extend from opposite sides of the main body. The apparel is initially secured to the garment hanger by resilient retainer clips formed on the distal ends of the foldable arms which are initially outstretched, and then the apparel and the arms are simultaneously folded about the main body of the garment hanger. The garment hanger also includes locking tabs formed on the main body of the garment hanger which engage the folded arms, and function to retain the folded garment and arms in a folded shape which is suitable for retail display and merchandising of the apparel. A preferred embodiment includes a first pair of upper foldable arms extending from the upper corners of the main body of the garment hanger, and a second pair of foldable arms extending from the lower corners of the main body, such that first and second articles of intimate apparel can be mounted on and folded about the main body in upper and lower display positions on the garment hanger.

17 Claims, 4 Drawing Sheets

GARMENT HANGER

BACKGROUND OF THE INVENTION

1. Field of the Invention

The present invention relates generally to a garment hanger, and more particularly pertains to a garment hanger which is suitable for packaging intimate apparel such as ladies panties.

2. Discussion of the Prior Art

The prior art has frequently packaged and merchandised intimate apparel and garments such as ladies panties in a clear plastic package, often referred to as a poly bag, wherein the packaged apparel is frequently retained in a suitable folded shape within the poly bag by the use of a suitable backing member such as a rectangular cardboard member or a plastic backing member about which one or more garments are folded, such that the garments are retained in a suitable folded shape for display within the poly bag.

SUMMARY OF THE INVENTION

Accordingly, it is a primary object of the present invention to provide a garment hanger which is suitable for packaging and displaying intimate apparel such as ladies panties. The garment hanger provides for folding of both the width and the length of the intimate apparel to reduce both the width and the length of the intimate apparel as it is packaged in a wrap around format for display during merchandising. The folding of both the width and the length of the intimate apparel can result in a significant savings of space for a merchandising retailer. Moreover, more than one intimate apparel garment can be packaged therein to provide a multi-pack mini-wrap packaging arrangement. The folded intimate apparel and garment hanger might or might not be further packaged in a poly bag for display during merchandising, and the poly bag can be closed at the bottom, or can be open at the bottom to allow customers to touch and feel the packaged intimate apparel. Alternatively, the folded intimate apparel and garment hanger can be further packaged in a different type of outer package such as two external half moons of polyester packaging material which might or might not have a nylon gun tag attached therethrough.

The garment hanger is preferably formed of one integrally molded piece of plastic which includes a main body about which the apparel is folded by a pair of foldable arms which extend from opposite sides of the main body. The foldable arms and the intimate apparel, supported thereon are subsequently folded to reduce the size of the final merchandising package, which is a significant positive consideration to a retailer. The apparel is initially secured to the garment hanger by resilient retainer clips formed on the distal ends of the foldable arms which are initially outstretched, and then the apparel and the arms are simultaneously folded about the main body of the garment hanger. The garment hanger also includes locking tabs on the main body of the garment hanger which engage the folded arms, and function to retain the folded garment and arms in a folded shape which is suitable for retail display and merchandising of the apparel.

A preferred embodiment includes a first pair of upper foldable arms extending from the upper corners of the main body of the garment hanger, and a second pair of foldable arms extending from the lower corners of the main body, such that first and second articles of intimate apparel can be mounted on and folded about the main body in upper and lower display positions on the garment hanger.

An alternative embodiment can package and display only a single apparel garment and can include only a single pair of upper foldable arms extending from the upper corners of the main body of the garment hanger, such that only a single article of intimate apparel is mounted on and folded about the main body in a display position on the garment hanger.

A further object of the subject invention is the provision of a garment hanger which is suitable for the packaging and merchandising of intimate apparel and garments such as ladies panties in a clear plastic poly pack, wherein the garment hanger retains the packaged apparel in a suitable folded shape for display within the poly pack.

BRIEF DESCRIPTION OF THE DRAWINGS

The foregoing objects and advantages of the present invention for a garment hanger may be more readily understood by one skilled in the art with reference being had to the following detailed description of several embodiments thereof, taken in conjunction with the accompanying drawings wherein like elements are designated by identical reference numerals throughout the several views, and in which.

DETAILED DESCRIPTION OF THE INVENTION

Figure 1:
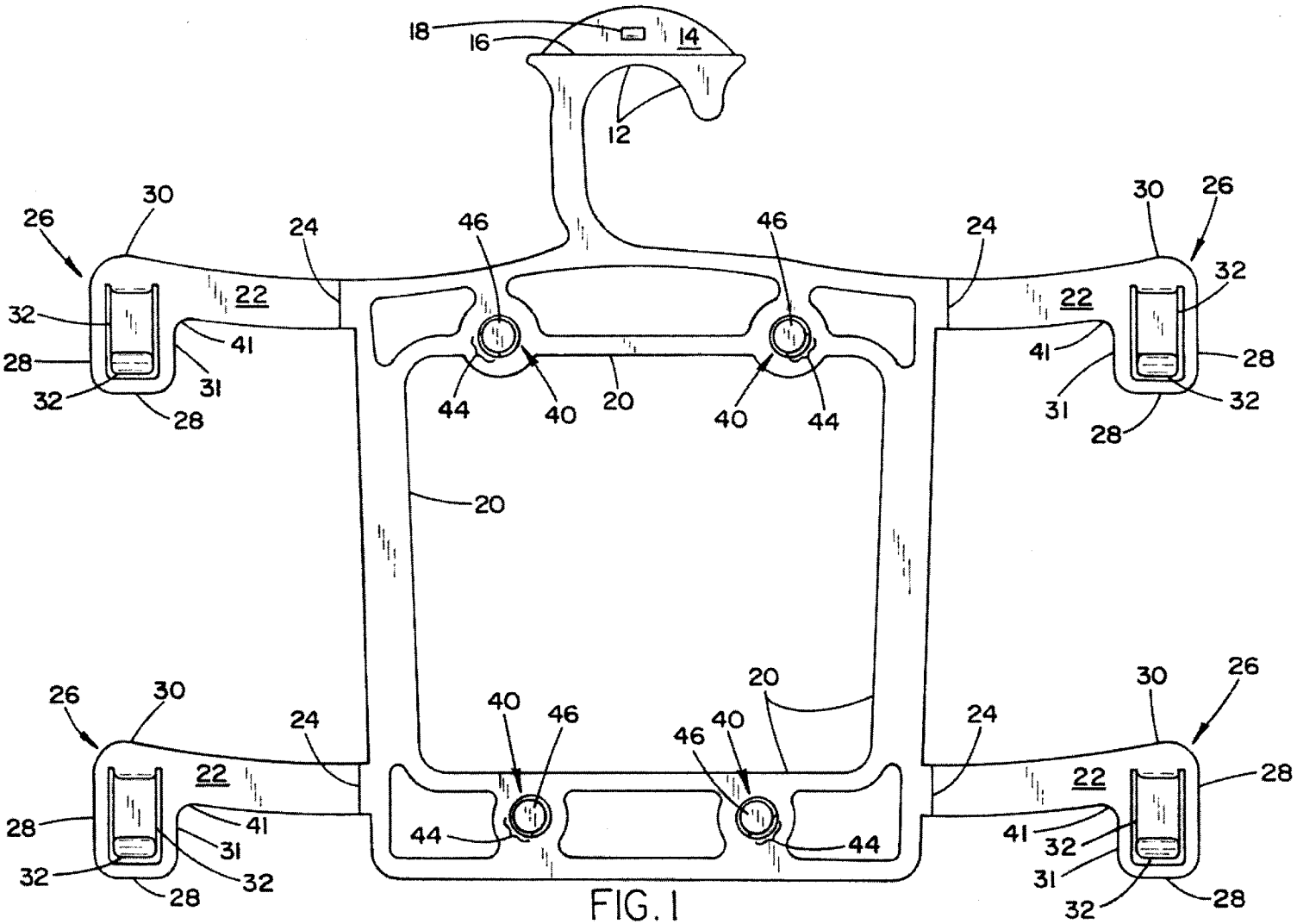
FIG. 1 is a front elevational view of one embodiment of a garment hanger pursuant to the present invention in an unfolded state, prior to the placement of a garment thereon and the folding of the garment and the garment hanger into a folded state.
Figure 3:
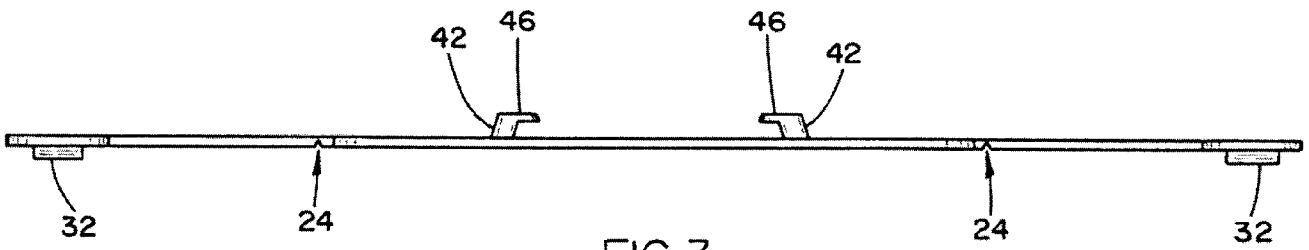
FIG. 3 is a bottom edge view of the garment hanger as shown in FIG. 1 in an unfolded state, prior to the placement of a garment thereon and the folding of the garment hanger into its folded state.
Figure 2:
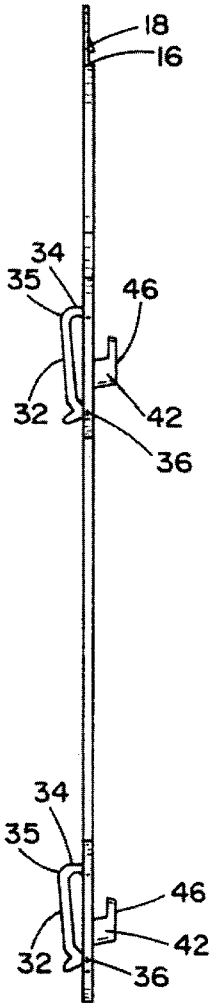
FIG. 2 is a left side edge view of the garment hanger as shown in FIG. 1 in an unfolded state, prior to the placement of a garment thereon and the folding of the garment and the garment hanger into its folded state.

FIG. 1 is a front elevational view and FIGS. 2 and 3 are respectively a left side edge view and a bottom edge view of one embodiment of a garment hanger pursuant to the present invention in an unfolded state, prior to the placement of a garment thereon and the folding of the garment and the garment hanger into a folded state.

The garment hanger is preferably molded as one integral plastic piece, and includes a top centrally located hanger portion 12, which might or might not incorporate a marker cap on top thereof to indicate a size or other descriptive detail.

Figure 5:
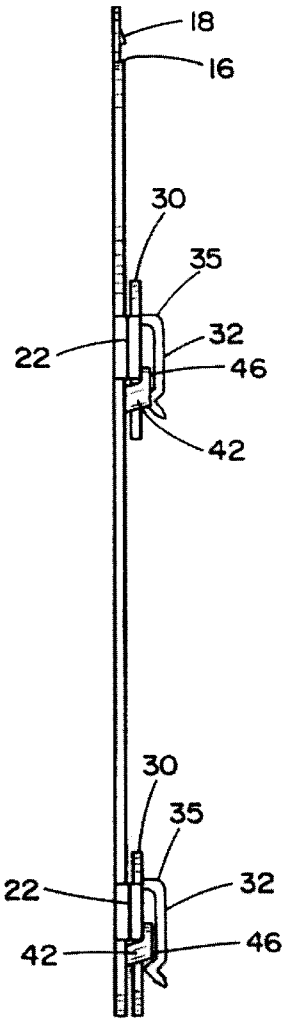
FIG. 5 is a left side edge view of the garment hanger as shown in FIG. 4, after folding of the garment hanger into its folded state.

The embodiment shown in FIG. 1 is designed to receive a marker cap on a reduced thickness, curved top hook portion 14 wherein the reduced thickness top portion terminates in a horizontally extending edge 16 formed where it joins the regular thickness main portion of the garment hanger. A small rectangular locking tab 18 is centrally located in the reduced thickness portion, and has a wedge shaped side profile, increasing in thickness toward its bottom, as shown in FIGS. 2 and 5, to secure a marker cap in place on the top reduced thickness portion.

The main body of the garment hanger includes a substantially rectangularly shaped central body frame 20 which has a slightly wider top portion and a slightly narrower bottom portion, with a foldable arm 22 and clip structure extending generally horizontally outwardly from each of the top and bottom, left and right corners of the substantially rectangularly shaped central body frame 20. Each of the four foldable arms 22 is secured to the substantially rectangularly shaped central body by a substantially vertically extending living hinge 24 formed by a V shaped, vertically extending notch formed in the back of each living hinge, as shown in FIG. 3.

Figure 6:
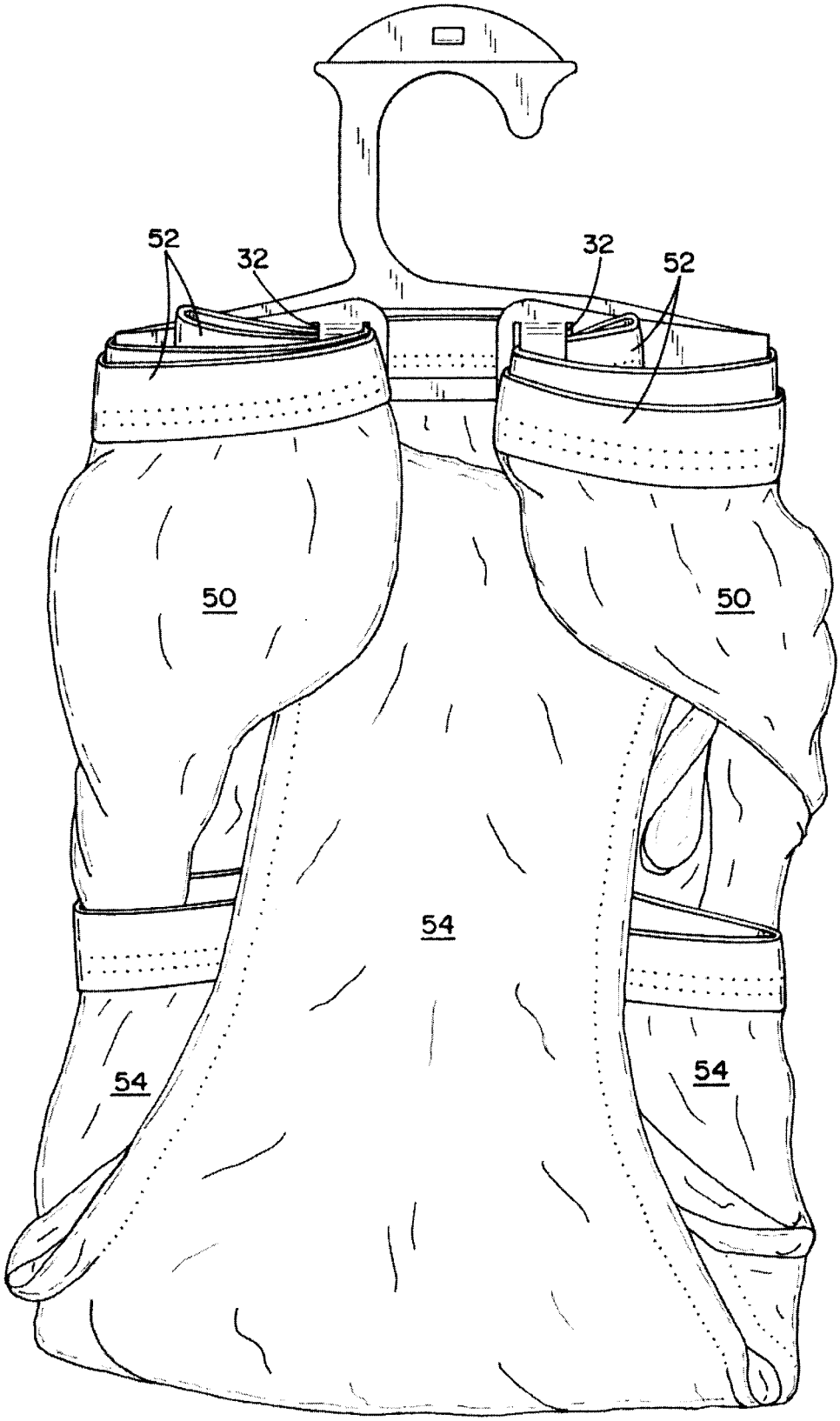
FIG. 6 is a front elevational view of the garment hanger in its folded state, similar to FIG. 4, with two intimate apparel garment panties placed thereon and folded and supported by the folded garment hanger.

Each foldable arm 22 and clip structure is symmetrically similar, and includes an integrally molded garment clip 26 at the outer distal end of each foldable arm which is formed by a rounded rectangular outer frame 28, 30, 31 extending around the garment clip. The top frame member 30 of the rectangular outer frame resiliently supports and mounts a generally rectangularly shaped resilient clip arm 32 which extends downwardly from the top frame member in general alignment within the rectangular outer frame. As shown in FIG. 2, the resilient clip arm 32 extends rearwardly away from the rectangular frame at the top at 34, and then curves downwardly at a position 35 spaced behind the rectangular frame. The resilient clip arm extends downwardly approximately parallel to the inside of the rectangular frame, while also being slanted forwardly such that as it extends downwardly it also slants closer to the rectangular frame, as shown in FIGS. 5 and 6. The lower end of the resilient clip arm includes a forwardly extending rounded nose 36 which is positioned within the bottom end of the rectangular frame, as shown best in FIG. 5.

The arrangement is such that the bottom end of the resilient clip arm can be bent away from the rectangular frame while a garment is being inserted into the clip, and thereafter the resilient clip arm retracts toward the outer rectangular frame, to resiliently grip the garment between the resilient clip arm and the outer rectangular frame.

The top and bottom frame sections of the main hanger body define four generally round locking tabs 40 which extend forwardly from the top and bottom frame sections at a location to interlock with and clip to the arm 22 and the inner frame member 31 of each garment clip near to the location where the outwardly extending arm 22 joins in a rounded curve 41 with the inner frame member 31 of the garment clip. Each generally round locking tab 40 defines a generally frustum-conical base member 42, illustrated in FIGS. 2, 3 and 5, which only extends around the bottom outer quarter corner, indicated by brackets 44 in FIG. 4, of the locking tab to support a rounded top 46 of the locking tab, while leaving the inner and top three quarters open beneath the round top 46 of the locking tab to interlock with and clip to the arm 22 and/or the inner frame member 31 of each garment clip near to the location where the outwardly extending arm 22 joins in a rounded curve 41 with the inner frame member 31 of the garment clip.

The arrangement is such that each arm 22 can be pivoted resiliently forwardly about its living hinge 24 and then further pivoted toward the main rectangular frame 20 of the garment hanger, until the rounded curve 41 defined at the joinder of the arm with the inner vertical frame member of the clip slips over the round top 46 of the locking tab, and is positioned under the open three top and inner quarters of the round top of the locking tab.

FIG. 2 is a left side edge view of the garment hanger as shown in FIG. 1 in an unfolded state, and illustrates a side view of each resilient clip arm 32 which extends downwardly from the top frame member in general alignment within the rectangular outer frame, and also shows the bottom lower quarter frustum-conical support 42 of each of the two left locking tabs 40, the horizontal edge 16, and the wedge profile of the locking tab 18.

FIG. 3 is a bottom edge view of the garment hanger as shown in FIG. 1 in an unfolded state, and illustrates a bottom view of each resilient clip arm 32, the living hinge 24 of each of the, two bottom foldable arms 22, and also shows the bottom lower quarter frustum-conical support 42 of each of the two lower locking tabs 40.

Figure 4:
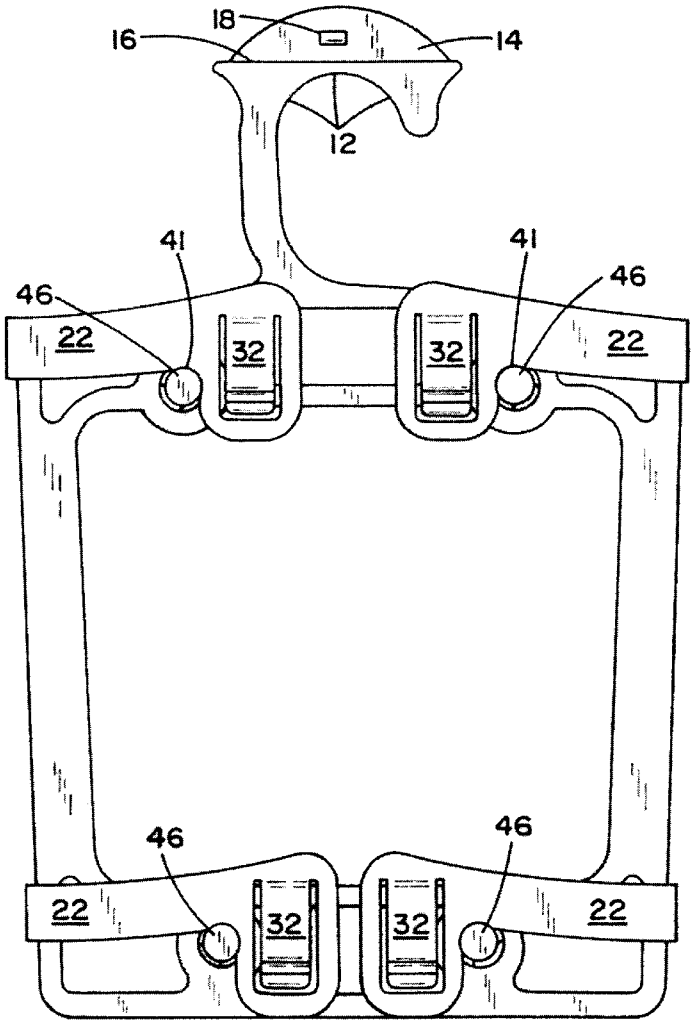
FIG. 4 is a front elevational view of the garment hanger of FIG. 1 after folding of the garment hanger into its folded state.

FIG. 4 is a front elevational view and FIG. 5 is a left side edge view of the garment hanger of FIG. 1 after folding of the garment hanger into its folded state, and shows the rounded curve 41 defined at the joinder of the arm 22 with the inner vertical frame member 31 of the clip slipped over the round top 46 of the locking tab and positioned under the open three top and inner quarters of the round top 46 of the locking tab 40.

In operative use of the garment hanger, while the garment hanger is positioned in its unfolded position as shown in FIGS. 1–3, one intimate apparel garment 50, such as ladies panties, is clipped under each clip arm 32 of the top two clips of the garment hanger, and a second intimate apparel garment 54 is clipped onto the bottom two clips 26 of the garment hanger and folded upwardly as shown in FIG. 6. Each of the arms is then pivoted and folded about its living hinge until it reaches the position shown in FIGS. 4 and 5, whereat the arm is secured in its folded position by engaging underneath the round top 46 of the locking tab 40. The package is then similar to that shown in FIG. 6, which is a front elevational view of the garment hanger in its folded state, similar to FIG. 4, with two intimate apparel garment panties 50, 52 placed thereon and folded and supported by the folded garment hanger.

The opposite side of the garment package shown in FIG. 6 would show two smoothly folded garments 50, 54 without the detail and clutter shown in FIG. 6, and the opposite side showing the two smoothly folded garments would be displayed in the front of a transparent poly pack as described above.

An alternative embodiment can package and display only a single apparel garment and can include only a single pair of upper foldable arms 26 extending from the upper corners of the main body of the garment hanger with the lower pair of foldable arms being omitted such that only a single article of intimate apparel is mounted on and folded about the main body on a display position on the garment hanger.

While several embodiments and variations of the present invention for a garment hanger are described in detail herein, it should be apparent that the disclosure and teachings of the present invention will suggest many alternative designs to those skilled in the art.

Having thus described our invention, what we claim as new and desire to secure by Letters Patent is:

1. A garment hanger for packaging and merchandising apparel, comprising:

a garment hanger main body, about which the apparel is folded;

a pair of foldable arms extending from opposite sides of the main body, including a resilient retainer clip formed on the distal end of each foldable arm, wherein the foldable arms are initially outstretched and the apparel is secured to the outstretched arms by the resilient retainer clips, and then the apparel and the arms are simultaneously folded against the main body of the garment hanger;

a pair of locking tabs formed on the main body of the garment hanger which engage the folded arms, and function to retain the folded garment and arms in a folded shape which is suitable for retail display and merchandising of the apparel.

2. The garment hanger of claim 1, wherein the garment hanger is formed as one integrally molded plastic piece.

3. The garment hanger of claim 1, wherein each locking tab extends forwardly from the main body at a location to interlock with and clip to each foldable arm.

4. The garment hanger of claim 1, further including:

a first pair of upper foldable arms extending from the upper corners of the main body of the garment hanger; and a second pair of foldable arms extending from the lower corners of the main body, such that first and second articles of apparel are mounted on and folded about the main body in upper and lower display positions on the garment hanger.

5. The garment hanger of claim 4, wherein top and bottom frame sections of the main body define locking tabs which extend forwardly from the top and bottom frame sections at a location to interlock with and clip to each foldable arm.

6. The garment hanger of claim 1, wherein each of the foldable arms is secured to the main body frame by a substantially vertically extending living hinge formed by a V shaped, vertically extending notch formed in the back of each living hinge.

7. The garment hanger of claim 1, wherein the main body of the garment hanger includes a substantially rectangularly shaped main body frame.

8. The garment hanger of claim 7, wherein the substantially rectangularly shaped main body frame has a slightly wider top portion and a slightly narrower bottom portion.

9. The garment hanger of claim 7, wherein each of the foldable arms is secured to the substantially rectangularly shaped main body frame by a substantially vertically extending living hinge formed by a V shaped, vertically extending notch formed in the back of each living hinge.

10. The garment hanger of claim 1, wherein the main body of the garment hanger includes a substantially rectangularly shaped main body frame which has a slightly wider top portion and a slightly narrower bottom portion, with a foldable arm extending generally horizontally outwardly from each of the top and bottom, left and right corners of the substantially rectangularly shaped main body frame, and each of the four foldable arms is secured to the substantially rectangularly shaped central body by a substantially vertically extending living hinge formed by a V shaped, vertically extending notch formed in the back of each living hinge.

11. The garment hanger of claim 1, wherein each resilient retainer clip at the distal end of each foldable arm is formed by a generally rectangular outer frame, and a top frame member of the rectangular outer frame resiliently supports and mounts a resilient clip arm which extends downwardly from the top frame member in general alignment within the rectangular outer frame.

12. The garment hanger of claim 11, wherein the resilient clip arm extends rearwardly away from the rectangular frame at the top frame member, and then curves downwardly at a position spaced behind the rectangular frame, and the resilient clip arm then extends downwardly approximately parallel to the rectangular frame while also being slanted forwardly to slant closer to the rectangular frame.

13. The garment hanger of claim 1, wherein each foldable arm joins in a rounded curve with an inner, vertically extending frame member of the resilient retainer clip.

14. The garment hanger of claim 13, wherein each locking tab defines a generally frustum-conical base member which only extends around the bottom, outer quarter corner of the locking tab to support a round locking top, while leaving the inner and top three quarters open beneath the round locking top, and each foldable arm can be pivoted resiliently forwardly about its living hinge and then further pivoted toward the main body of the garment hanger, until the rounded curve defined at the joinder of the foldable arm with the inner vertically extending frame member of the resilient retainer clip slips over the round locking top of the locking tab, and is positioned restrained under the round locking top of the locking tab.

15. The garment hanger of claim 1, further including:

a curved top hook portion designed to receive a marker cap on a top reduced thickness portion which terminates in a horizontally extending edge formed where the top reduced thickness portion joins a regular thickness portion of the garment hanger;

a rectangular locking tab centrally located in the reduced thickness portion and having a wedge shaped side profile, increasing in thickness toward its bottom, to secure a marker cap in place on the top reduced thickness portion.

16. A method of using the garment hanger of claim 1, wherein while the garment hanger is positioned in its unfolded position, an apparel garment is clipped onto the pair of resilient retainer clips of the garment hanger, and each of the arms is then pivoted and folded until it reaches a folded position whereat the arm is secured in its folded position by engaging underneath a locking tab.

17. A method of using the garment hanger of claim 5, wherein while the garment hanger is positioned in its unfolded position, one apparel garment is clipped onto the top pair of resilient retainer clips of the garment hanger, and a second apparel garment is clipped onto the bottom pair of resilient retainer clips of the garment hanger, and each of the arms is then pivoted and folded until it reaches a folded position whereat the arm is secured in its folded position by engaging underneath a locking tab.

* * * * *